US009394036B2

(12) United States Patent
Krietzman

(10) Patent No.: US 9,394,036 B2
(45) Date of Patent: Jul. 19, 2016

(54) DYNAMIC CURRENT PROPULSION FOR WATER BOARDS

(71) Applicant: Graem Sequoia Krietzman, Palos Verdes Estates, CA (US)

(72) Inventor: Graem Sequoia Krietzman, Palos Verdes Estates, CA (US)

( * ) Notice: Subject to any disclaimer, the term of this patent is extended or adjusted under 35 U.S.C. 154(b) by 107 days.

(21) Appl. No.: 13/957,350

(22) Filed: Aug. 1, 2013

(65) Prior Publication Data

US 2014/0162510 A1 Jun. 12, 2014

Related U.S. Application Data

(60) Provisional application No. 61/678,294, filed on Aug. 1, 2012.

(51) Int. Cl.

| | |
|---|---|
| ***B63B 35/83*** | (2006.01) |
| ***B63B 35/79*** | (2006.01) |
| ***B63H 1/38*** | (2006.01) |

(52) U.S. Cl.

CPC ..... *B63B 35/7906* (2013.01); *B63H 1/38* (2013.01); *B63B 2035/7903* (2013.01)

(58) Field of Classification Search

CPC ..... B63H 19/02; B63B 35/83
USPC ..... 441/65, 74, 76, 77; 440/9, 17, 19
See application file for complete search history.

(56) References Cited

U.S. PATENT DOCUMENTS

| | | | | |
|---|---|---|---|---|
| 1,480,366 | A * | 1/1924 | Bergerson | 441/60 |
| 4,915,659 | A * | 4/1990 | Sanders | 441/76 |
| 6,431,933 | B1 * | 8/2002 | Saghri | 441/65 |
| 8,435,092 | B1 * | 5/2013 | Smith | 441/65 |

* cited by examiner

*Primary Examiner* — Edwin Swinehart

(57) ABSTRACT

Disclosed herein is a method of water board propulsion comprising placing a buoyant board with a flexible water catching pocket having an open proximal end and at least a partially closed distal end affixed to a bottom surface of the water board in a current of water moving at a speed which is faster than the buoyant board; positioning said open proximal end to receive the flowing water; receiving water flow into the open proximal end; and, accelerating the board in the direction the current with greater acceleration than the same board without a water catching flexible pocket.

5 Claims, 17 Drawing Sheets

DYNAMIC CURRENT PROPULSION FOR WATER BOARDS

BACKGROUND

1. Field

This disclosure relates generally to environmental propulsion water board devices.

2. Background

On Jul. 9, 1971, Tom Morey invented the modern bodyboard. That invention changed the world. Water boards such as bodyboards, wave boards, boogie boards and surf boards are popular and enhance water activities and leisure. One challenge for water board users' is learning to and experiencing the capture of a wave or swell to position themselves to ride the flow of water.

Ocean waves consist of water, wind, gravity and earthquakes all transfer energy to waves, waves are energy moving through the ocean to the beach in the form of a wave. But the water itself is not moving forward as in a current. Instead, the energy rolls through the water in a circular motion called a wave orbital. The crest of a wave is the top of a wave orbital, and the trough of a wave is the bottom of a wave orbital. When the waves reach the shore they expend their energy by breaking and then moving sand and shaping the beach.

As waves move towards shore, the ocean floor impacts their progress via shoaling, this causes the wave orbitals to flatten as the bottom shoals. When waves interact with the ocean floor (or terrace) near the shore, they slow down and bunch together (decrease their wavelength); but the time between wave crests (period) does not change. The height of the wave will initially decrease when it feels bottom, but then will steadily increase until the wave becomes unstable and breaks (often near the ocean floor face) near the berms and beach. The water literally falls over. Waves expend the energy they gained from the wind by transferring that energy to the beach when they break.

A spilling wave occurs when a gradually sloping ocean floor causes the wave to become steeper and steeper until the crest spills down the face of the wave in a rush of foaming whitewater. The wave continues in this manner until its energy is dissipated in a froth near the shore.

Spilling waves break for a longer time than other waves, providing ample energy at the start of the ride and a gentle decrease in power as the wave nears the shore. For beginners who are just learning to body board or surf this is ideal.

DESCRIPTION

Disclosed herein are exemplary implementations of devices, methods and systems to use environmental energy to propel water board devices.

In some exemplary implementations there are disclosed aspects of a method of water board propulsion, including placing a buoyant board with a flexible water catching pocket having an open proximal end and at least a partially closed distal end affixed to a bottom surface of the water board in a current of water moving at a speed which is faster than the buoyant board; positioning said open proximal end to receive the flowing water; receiving water flow into the open proximal end; and, accelerating the board in the direction the current with greater acceleration than the same board without a water catching flexible pocket. In some instances the method may further comprise allowing a portion of the water filling the pocket to vacate the pocket via apertures in the pocket. Said flexible water catching pocket expanding as water flows into said pocket. Said flexible water catching pocket at least partially collapses when the water board's speed is at least greater than or about equal to the speed of the current water.

In some exemplary implementations there are disclosed aspects of a method of water board propulsion, including a method of water board propulsion, the method including placing a buoyant board with a water catching semi-rigid flap body rotatably attached at a first end to the bottom surface of the water board in a current of water flowing at a speed which is faster than the buoyant board; positioning an unattached second end of the water catching semi-rigid flap body to receive the flowing water; receiving water flow into the open proximal end; and, accelerating the water board in the direction the current of the flowing water with greater acceleration than the same water board without a water catching semi-rigid flap body. The method may further comprise the water catching semi-rigid flap body at least partially expanded by rotating from generally parallel with the bottom section of the water board to angled relative to the bottoms section. The method may further comprise the water catching semi-rigid flap body at least partially collapsed when the water board's speed is at least about equal to the speed of the flowing water.

In some exemplary implementations there are disclosed aspects of a method of water board propulsion, including a method of water board propulsion, the method including placing a buoyant board with a water catching semi-rigid flap body rotatably attached at a first end to the bottom surface of the water and having flexible side walls mounted between the water catching semi-rigid flap body sides and the bottom surface of the water board which expand or collapse dependent on if the water current flow has equal or less acceleration than the water board. In some instances the method may further comprise the water catching semi-rigid flap body at least partially expanded by rotating from generally parallel with the bottom section of the water board to angled relative to the bottoms section. In some instances the method may further comprise the water catching semi-rigid flap body at least partially collapsed when the water board's speed is at least about equal to the speed of the flowing water.

In some exemplary implementations there are disclosed aspects of a method of water board propulsion, including a method of water board propulsion, the method including placing a buoyant board with a head, tail, bottom, top and a buttress stop having a water catching semi-rigid flap body with a bottom mounted pivot, a trailing edge and a leading edge, whereby the leading edge is on the head side of the pivot and the trailing edge is on the tail side of the pivot. The semi-rigid flap body being rotatably attached at a first end to the bottom surface of the board; placing the buoyant board in a current of water flowing at a speed which is faster than the buoyant board; positioning an unattached second end of the water catching semi-rigid flap body to receive the flowing water; receiving water flow into the open proximal end; stopping the rotation of the flap body via the physical contact of the leading edge and the buttress cavity or stop and, accelerating the water board in the direction the current of the flowing water with greater acceleration than the same water board without a water catching semi-rigid flap body.

In some exemplary implementations there are disclosed aspects of a propulsion pocket including a frame; a pocket of flexible material with a front and two flexible sides connected at one edge to a bottom and at the other edge to said frame; and, a means to solidly fix the frame to a water board's bottom section. Means to mount a frame to a water board bottom section includes at least one of adhesives, cement, fasteners, latches, catches and welds. In some instances the bottom section of a flexible pocket surge catcher is flexible but more ridged than the side walls.

In some exemplary implementations there are disclosed aspects of a water board with propulsion pocket including a board having a buoyant core with a tail, nose, top and bottom surface and at least one pocket having a flexible front wall, flexible side walls and a bottom affixed to the bottom surface of the water board.

In some exemplary implementations there are disclosed aspects of a water board with propulsion pocket including a board having a buoyant core with a tail, nose, top and bottom surface and at least one pocket having a flexible front wall, flexible side walls and a bottom affixed to the bottom surface of the water board; wherein a portion of the bottom section of the water board forms an upper boundary of the at least one flexible pocket; the at least one pocket has a distal end that is at least partially closed; and, the at least one pocket has an open proximal end.

In some exemplary implementations there are disclosed aspects of a water board with propulsion pocket including a board having a buoyant core with a tail, nose, top and bottom surface and at least one pocket having a flexible front wall, flexible side walls and a bottom affixed to the bottom surface of the water board; wherein a portion of the bottom section of the water board forms an upper boundary of the at least one flexible pocket; the at least one pocket has a distal end that is at least partially closed; and, the at least one pocket has an open proximal end. An opening limiter which prevents the bottom of the surge catcher from expanding further than a pre selected limit may be added to limit surge catcher expansion. The opening limiter having a first interface and a second interface; and, whereby the first interface is adjacent to the bottoms section of the water board and the second interface is adjacent to the bottom of the surge catcher.

In some exemplary implementations there are disclosed aspects of a water board with propulsion including a board having a buoyant core with a tail, nose, top and bottom section; at least one semi-rigid planar flap with a distal end, proximal end and sides; a pivot near the distal end; a leading edge on one side of the pivot at the distal end of the planar flap; a trailing edge on a second side of the pivot and at the proximal end of the planar flap; a pivot mounting guide wherein the pivot is mounted to the bottom surface of the water board; and, and a stop cavity formed in the water board whereby the rotation of the leading edge about the pivot is limited.

The disclosure may be better understood by referring to the following figures. The components in the figures are not necessarily to scale, emphasis instead being placed upon illustrating the principles of the disclosure. In the figures, like reference numerals designate corresponding parts throughout the different views. All callouts in any appendices and/or figures are hereby incorporated by this reference.

BRIEF DESCRIPTION OF THE FIGURES

The disclosure may be better understood by referring to the following figures. The components in the figures are not necessarily to scale, emphasis instead being placed upon illustrating the principles of the disclosure. In the figures, like reference numerals designate corresponding parts throughout the different views. All callouts in any appendices and/or figures are hereby incorporated by this reference.

FIG. 1D is an exemplary implementation of some aspects of a surge catcher flap with upper boundary wall;

All descriptions and callouts in the Figures and all content are hereby incorporated by this reference as if fully set forth herein.

FURTHER DESCRIPTION

In the following description of examples of implementations, reference is made to the accompanying drawings that form a part hereof, and which show, by way of illustration, specific implementations of the present disclosure that may be utilized. Other implementations may be utilized and structural changes may be made without departing from the scope of the present disclosure.

An object at rest surrounded by moving water can be propelled with the flow of the water (current). In the case of a water board rider near a beach, the rider and his or her board migrate from beach to remote from the beach (in water) waiting to ride a wave into the beach and then repeats the process.

In aspects of some exemplary implementations disclosed herein a dynamic element affixed to or formed as part of a water board improves the efficiency of the water board and rider going from moving little with swells and surges of water current flowing to the shore and beach to moving more with such current flow.

Anyone who has ridden a water board such as a surf board, body board, inflatable raft and the like will recall that "catching" a ride require the coordination of position of board and rider with the water moving to shore and the need to increase the speed of the rider and board to "catch-up" with the flow of water surging as part of the swell heading to shore. If the water board and rider are moving to slowly the swell, froth or white water may pass by. If the wave has crested and the rider and board are moving to slowly in the trough the wave crashes down on the rider.

Exemplars herein disclose a variety of implementations utilizing surge catching devices to improve the rider on a board going from moving to slow to catch a wave to going fast enough to ride a wave. Dynamic characteristics of some surge catchers include disclosure of flaps and planar devices which change position or shape in response to position of water board and at least one of speed and direction of following water. Positional changes may be used to assist in propelling a water board and rider on a flow of water or wave.

Figure 1A:
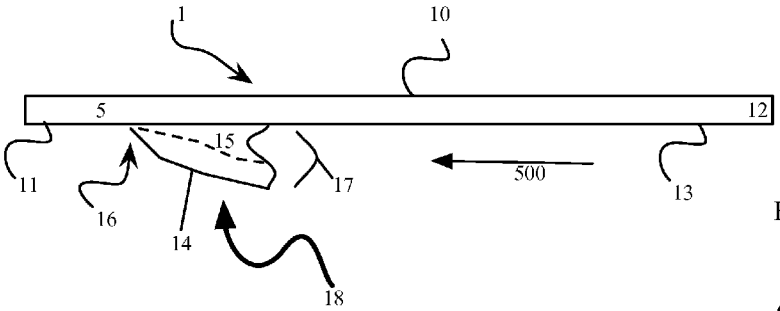
FIG. 1A-1E are side, bottom and partial views of a surge catcher and a water board showing some aspects of exemplary implementations of a surge catcher.
Figure 1B:
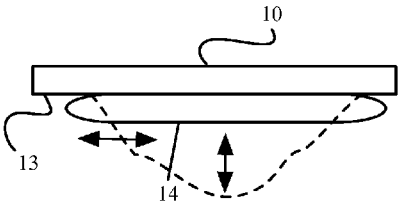
Figure 1C:
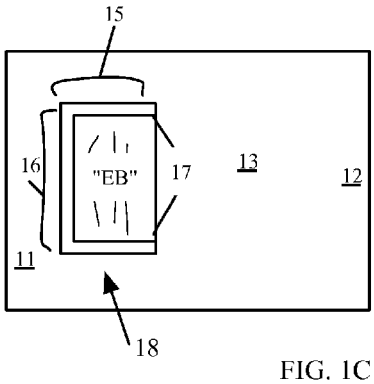

Shown in FIGS. 1A, 1B and 1C is an exemplary implementation of a water board with propulsion. A water board includes surfboard, paddle board, body board, boogie board, wave board and the like. Typical of water boards is buoyancy. Water board 1 has a buoyant deck 5 which forms the core of the device having a top surface 10, a front portion (also known as a "nose") 11, a back portion (also known as a "tail") 12 and a bottom surface 13. A flexible or partially flexible flap body 14 is affixed to the bottom surface 13 of the water board. The flap body 14 has a exterior bottom "EB", sidewalls 15, a distal end 16 and a proximal end 17. The flap body is constructed of flexible material When the flap body 14 is mounted or affixed to the bottom surface of a water board it forms a surge catcher 18 wherein it has a substantially closed distal end 16 and a substantially open proximal end 17 when affixed to the bottom surface 13. In some instances the surge catcher may be formed as at least part of the bottom surface of the water board.

Via the openable proximal end 17 water 500 may pass in and out of the surge catcher 18. Water, in this instance, refers to flowing water in front of a wave, over a wave, or down the wave face. A body board with surge catcher will utilize one or more of wave, current and onshore water flow to accelerate or propel the water board.

Figure 1D:
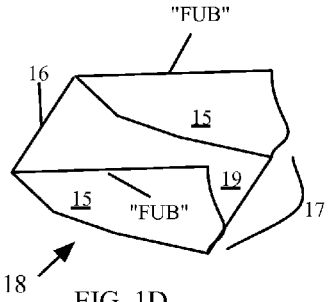

Also, shown in FIG. 1D is a view of the interior bottom 19 of a flap body 14. The distal end is a wall at the front of the pocket and the proximal end is at the back of the pocket. The back of the pocket corresponding with the back of the water board. Each side wall and front wall (distal end) have an edge connected to the bottom and a flap upper boundary edge "FUB" mounted or affixed directly, or via a frame, to the bottom surface 13 of a water board. In some instances implementations with flexible flap material (such as side walls or all walls) may be defined by their position relative to the nose and tail of the wave board. In some instances the interior bottom 19 may appear substantially continuous with the side walls and/or the front wall (distal end)—an important point being the walls have an end that affixes to or mounts adjacent to the bottom surface 13 of the water board.

Figure 1E:
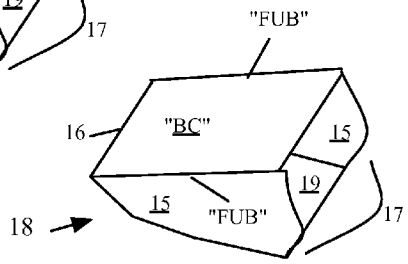

A portion of the bottom surface 13 of the water board may be the ceiling or an upper boundary wall of the surge catcher 18. Those of ordinary skill in the art will recognize that illustrating a portion of the bottom surface as an upper boundary is merely a design choice and that forming, attaching or adding on a flap upper boundary edge "FUB" to the flap body 14 is within the scope of this disclosure see generally FIG. 1E. Also, shown in FIG. 1E is a view of the flap body 14. The distal end is a wall at the front of the pocket and the proximal end is open at the back of the pocket. The back of the pocket corresponding with the back of the water board. Each side wall and front wall (distal end) have an edge connected to the bottom and an edge mounted or affixed directly to, or via a frame such as a flap upper boundary ceiling "BC", to the bottom surface 13 of a water board. In some instances with flexible flap material the walls may be defined by their position relative to the nose and tail of the wave board. In some instances the bottom 19 may appear substantially continuous with the side walls and/or the front wall (distal end)—the important point being the walls have an end that affixes to or mounts adjacent to the bottom surface 13 of the water board.

When a user/rider of a water board swims against the flow of water (current) 500 the flexible surge catcher will collapse or compress sides and bottom thereby reducing drag and making moving offshore to "catch" a ride easier then if the surge catcher were extended.

A surge catcher may dynamically expands and collapses in response to one or more of position of water board, velocity or water, current, velocity of water board, acceleration of water and acceleration of water board. In some exemplary implementations the surge catcher may be fixed in at least a partially expanded condition.

The flap body 14, as shown in FIG. 1B, is at least partially flexible whereby it may open larger at the proximal end or close down smaller in response to fluid flow. This flap body is without a frame.

Figure 2:
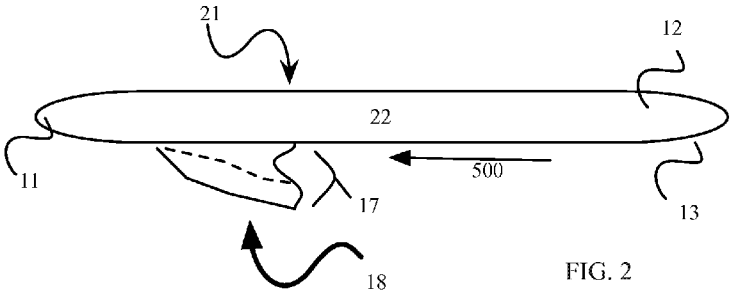
FIG. 2 is a side view of some aspects of an exemplary implementation of a inflatable water board with surge catcher.

FIG. 2 shows a water board 21, in this instance at least partially inflated with a inflated body 22, a top, a front portion 11, a back portion 12 and a bottom surface 13 with a surge catcher 18 affixed to said bottom surface. Affixation is a solid fixing and not a rotation or a stretching mount.

Figure 3A:
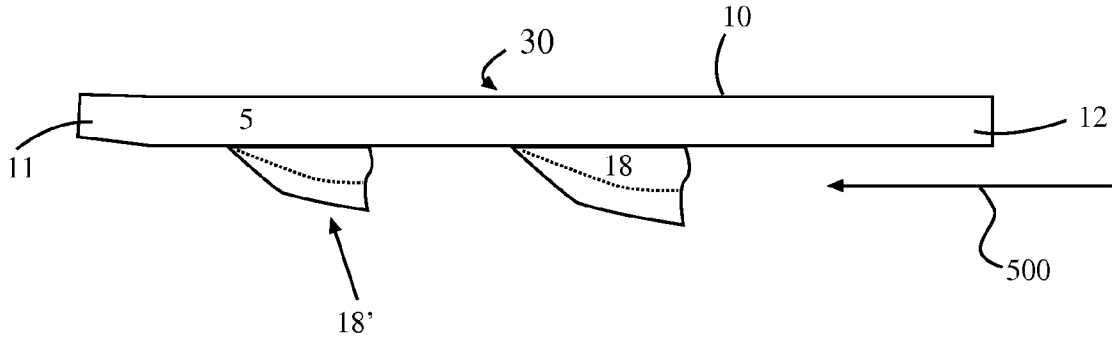
FIGS. 3A and 3B are top and side views of some aspects of exemplary implementations of a water board with surge catchers.
Figure 3B:
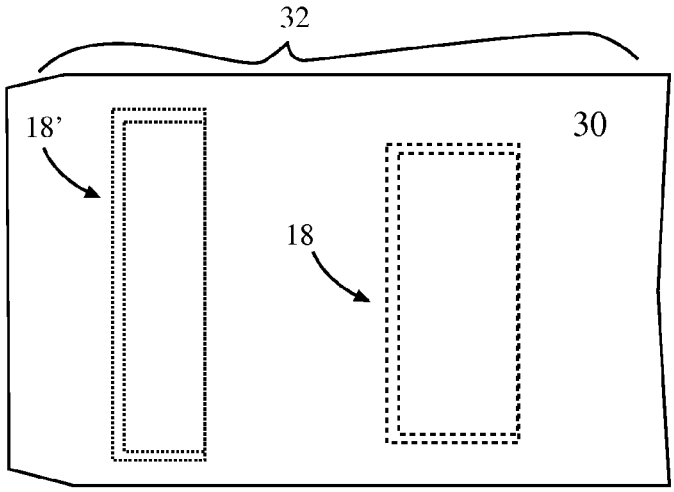

FIGS. 3A and 3B show a water board 30 with a buoyant body 5 having a front 11 and back 12 and a bottom 13, a first surge catcher 18, a second surge catcher 18' and two side 32 (also known as rails); surge catchers 18 and 18' are each affixed to said bottom surface.

Figure 4A:
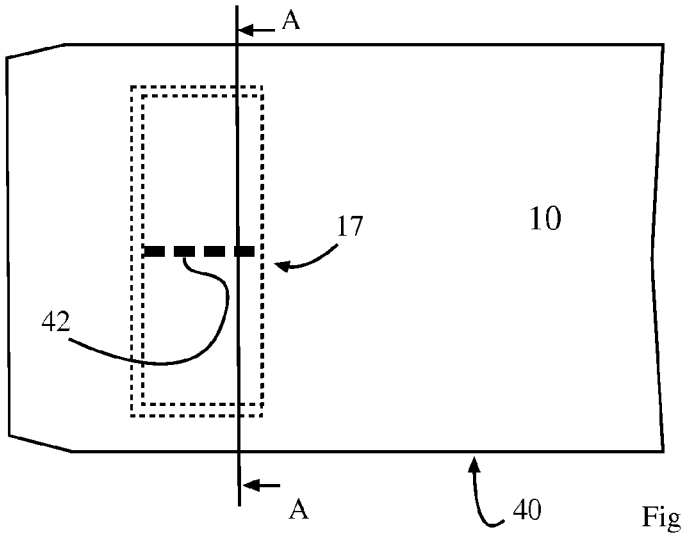
FIGS. 4A-4C are top and back views of some aspects of exemplary implementations of a water board with surge catcher.
Figure 4B:
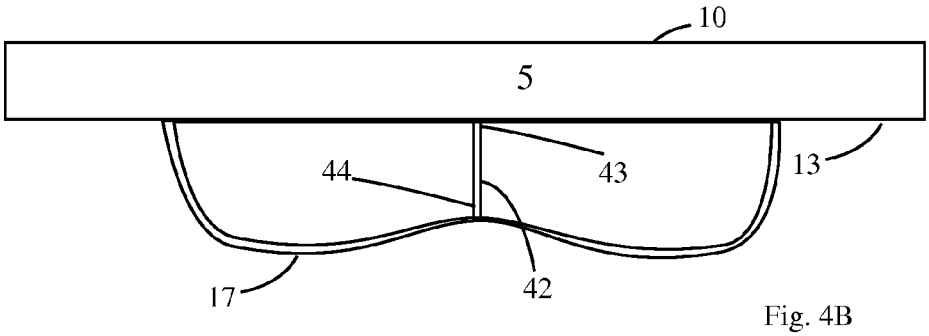
Figure 4C:
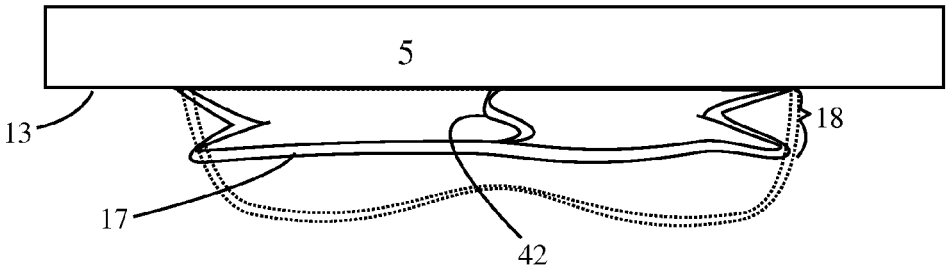

FIGS. 4A to 4C show a water board 40 with a buoyant body 5, a top surface 10, a front portion 11, a back portion 12 and a bottom surface 13. In this configuration there are multiple surge catchers formed at the interface of the flap body and the bottom surface 13 of the water board 40. A first surge catcher 18 and a second surge catcher 18' are each affixed to said bottom surface. In some instance one or more opening limiters forming a bifurcated pocket are interspaced between the open proximal end of the surge catcher and the bottom surface 13 of the water board. The opening limiter 42 has a first interface 43 with the bottom section 13 of the water board and a second interface 44 with the bottom 19 of the surge catcher. The surge catcher as shown in FIG. 4C is collapsible wherein its sides 18 may fold inward (or outward) to accommodate the force of water passing thereby when the water board accelerates or in some cases paces the water flow (current). Each opening limiter 42 is a strip or piece of flexible material that is connected to the bottom section of the surge catcher and which also folds or deforms to allow the proximal end 17 of the surge catcher 18 to move closer to the bottom surface 13 of the water board. The opening limiter, in some instances, forms a bifurcating divider for at least a portion of the surge catcher pocket.

Figure 5:
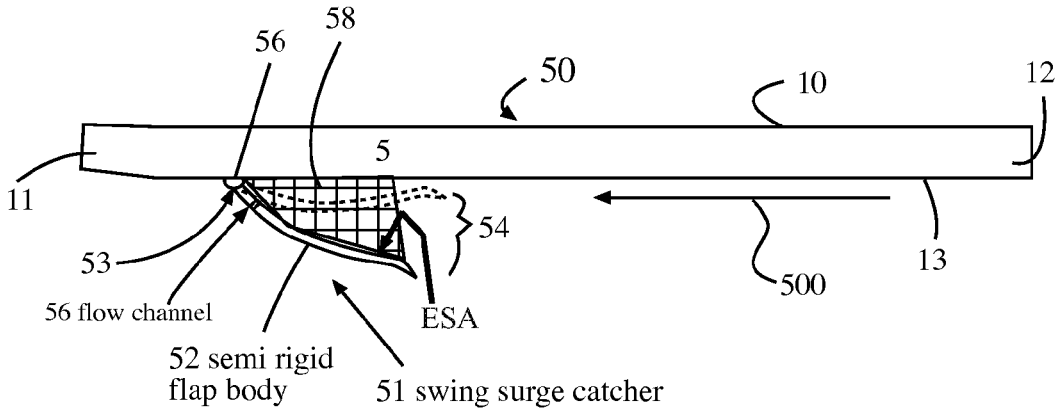
FIG. 5 shows some aspects of an exemplary implementation of side view of water board with swing surge catcher.

FIG. 5 shows a water board 50, with a generally planar swing surge catcher 51 attached. In this instance the flap body 52 is at least semi-rigid and tends to hold its generally planar shape when pushed on by flowing water. It has flexibility like the extended portion of a swim fin. At a first end 53 this flap body 52 is movable affixed to the bottom surface 13. A second end 54 is free to rotate about the first end 53 and movable relative to the bottom surface 13. When rotated the swing surge catcher 51 moves back and forth between generally parallel with the bottom surface 13 and at an angle to the bottom surface 13. The first end is affixed to the bottom surface via a dynamic anchor 56 such as a hinge, pivot, guide, armature, flexible neck, gasket, living hinge formed of plastic or bushing. When water 500 moves towards the second end it can push the second end away from the bottom surface 13 thereby rotating the flap body 52 and exposing an extended surface area "ESA" at an acute angle from the bottom surface 13 against which the water 500 pushes thereby moving the water board 50 forward. Flexible side which may include mesh or other soft non-mesh material 58 maybe added on each side of the semi-rigid flap body 52 to limit access of hands, fingers, feet and the like into the side area between the semi-rigid flap body and the bottom surface of the water board as well as in some instances reduce overflow of water out the sides of the flap body.

Optional apertures or flow channels 56 may be interposed through the swing surge catcher to allow some of the water 500 to escape. The flow channels or apertures 56 may be sealable.

Figure 6A:
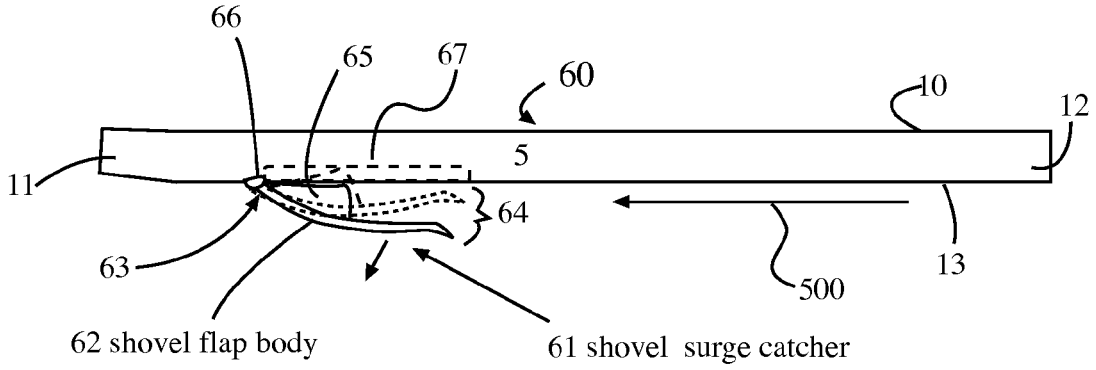
FIGS. 6A and 6B are side and bottom views of some aspects of an exemplary implementation of a water board with shovel surge catcher.
Figure 6B:
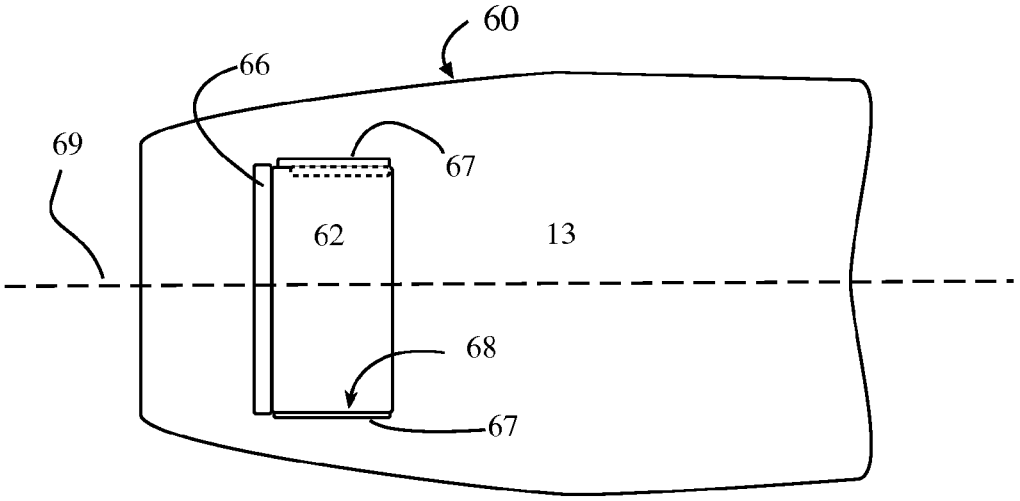

FIGS. 6A and 6B show a water board 60, with a shovel surge catcher 61 attached. In this instance the flap body 62 is at least semi-rigid. It has flexibility like the extended portion of a swim fin. At a first end 63 the flap body 62 is movably affixed to the bottom surface 13. A second end 64 is free and movable relative to the bottom surface 13. At least a portion of the vertical sides 65 extend upward from the flap body 62 towards the bottom 13. When water 500 moves towards the second end it can push the second end away from the bottom 13 thereby rotating the flap body 62 and providing a second surface against which the water 500 pushes—the first surface being the bottom surface 13 of the water board. via the sides of flap body 62. The first end is affixed via a dynamic anchor 66 such as a hinge, pivot, flexible neck, gasket, living hinge formed of plastic or bushing. Optional apertures (not shown here) or flow channels may be interposed through the shovel surge catcher to allow some of the water 500 to escape. The flow channels or apertures 56 may be sealable. Vertical sides 65 can mate with catches 67 formed on the bottom 13 (when closest to bottom of board) thereby providing a more limited profile when the shovel surge catcher rotates forward when the water board is moving faster than or even with the current (relative movement of surrounding media) of the water 500. The force of the moving water moves the water board 60 forward. The vertical sides 65 extend at or near the sides 68 of the flap body 62. The vertical sides 65 can reduce some water spillover of water leaving the sides of the surge catcher generally perpendicular to the centerline 69 of the water board.

Figure 7:
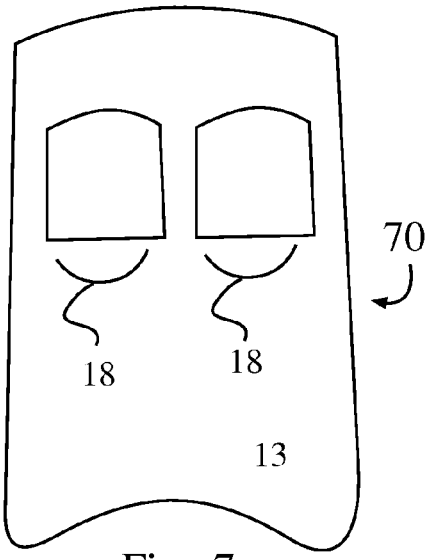
FIG. 7 is a bottom view of some aspects of an exemplary implementation of water board with twin surge catchers.
Figure 8:
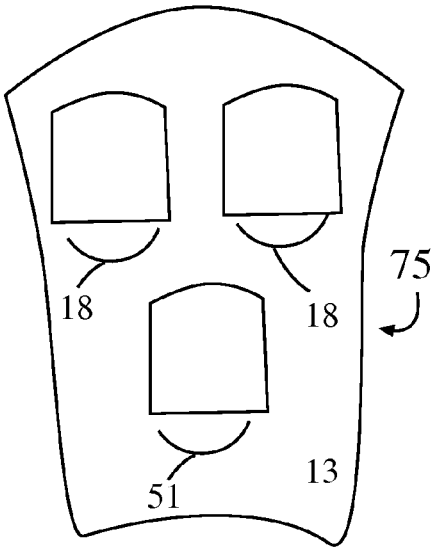
FIG. 8 is a bottom view of some aspects of an exemplary implementation of water board with triple surge catchers.
Figure 9:
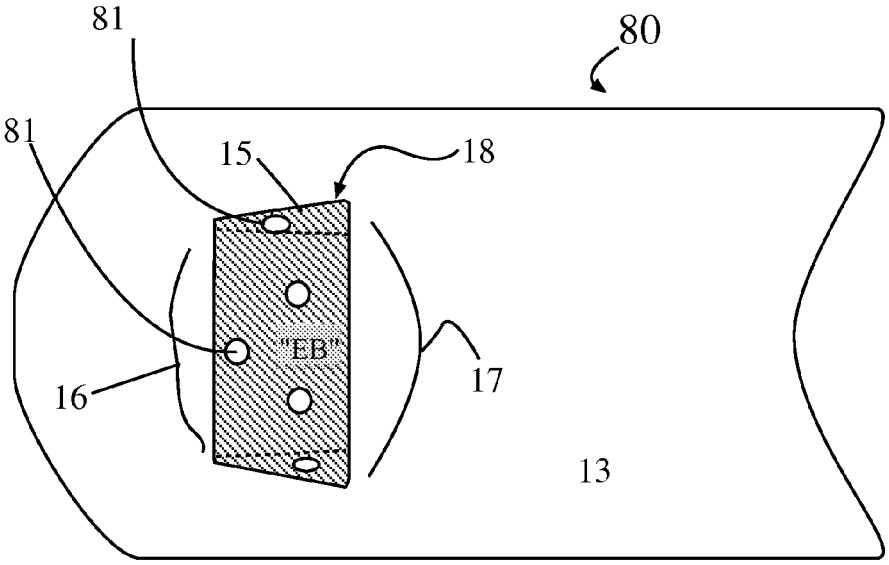
FIG. 9 is a bottom view of some aspects of an exemplary implementation of water board with aperture surge catcher.

FIG. 7 shows a water board 70 with dual surge catchers 18. FIG. 8 shows a water board 75 with triple surge catchers. Two flap body 14 surge catchers 18 and one semi rigid flap body 52 swing surge catcher 51. FIG. 9 shows a water board 80 with an aperture flap body 14 surge catcher 18 having an open proximal end 17 and a closed distal end 16. Apertures 81 are formed in said flap body whereby some of the water pushing on the surge catcher may flow through side 15 and/or the bottom wall 20.

Figure 10A:
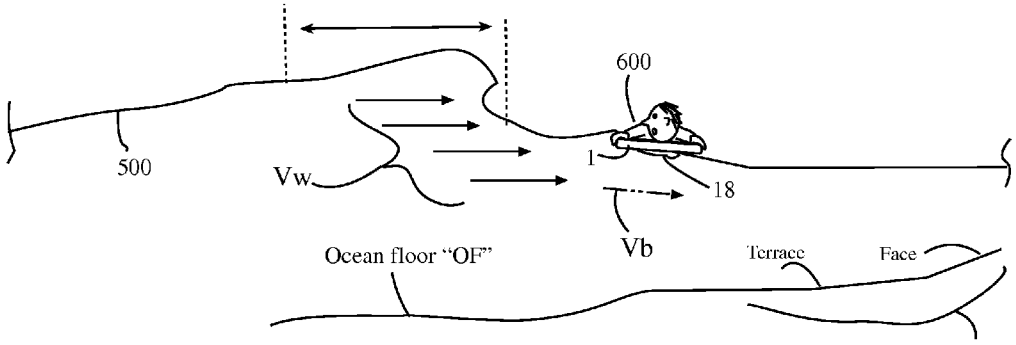
FIGS. 10A-10C are sequential views of some aspects of exemplary implementation of a surge catcher board and rider.
Figure 10B:
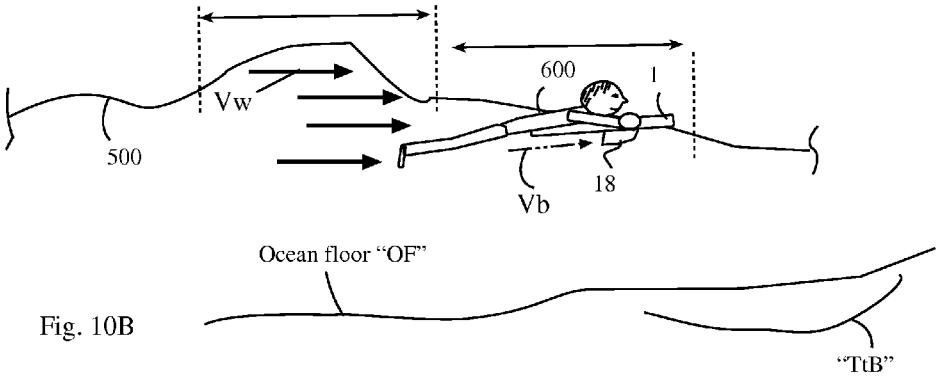
Figure 10C:
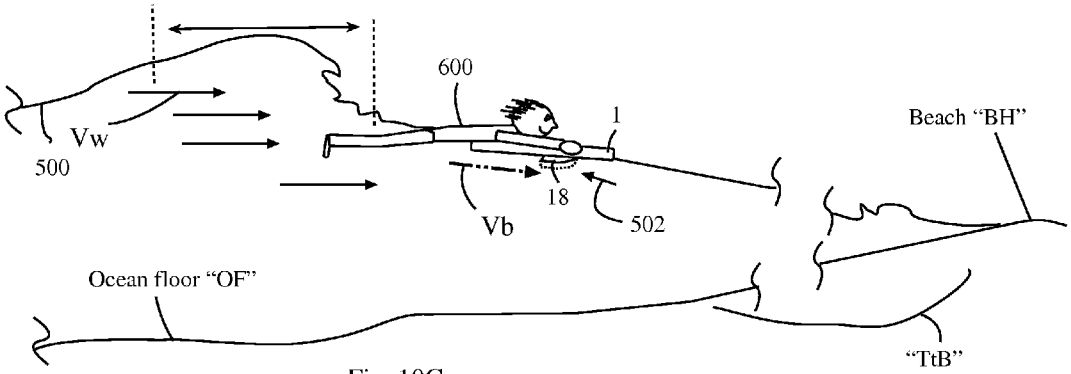

FIG. 10A through 10C showing a method catching a ride on a shore traveling surge of water or wave utilizing a buoyant water board with surge catcher. FIG. 10A shows water 500 and a water board 1 with rider 600. The velocity of the water 500 behind the water board 1 and moving towards shore "Vw" which is exceeding the velocity of the water board "Vb". By positioning the water board 1 and surge catcher generally 18 perpendicular to the flow of water 500 onshore the surge catcher 18 is ill positioned to use moving water to fill the flap or planar surge catcher and accelerate the water board 1. Rather, FIG. 10A depicts a rider waiting for a wave, or swell and not positioned to ride.

FIGS. 10B and 10C illustrate positioning the water board and surge catcher in relationship to water and the movement of water 500. The velocity of water board "Vb" is the relative velocity of the water board to the water. Surge catchers' disclosed herein, unless fixed or partially fixed, can dynamically adapt to water surrounding the water board. For example, water 500 moving from behind the water board 1 towards shore, that water has a relative velocity compared to the water board. The movement of water with a velocity "Vw" moving towards the terrace, face, berms and beach "BH" is illustrated in FIGS. 10B and 10C. When "Vw">"Vb" the movement of water flowing from behind the water board is greater than the velocity of the water board. If the open portion of a surge catcher flap, or a trailing edge of a planar surge catcher is oriented facing a flow of water "Vw" heading towards the shore or beach "BH" said surge catcher 18 encounters the water flow and may expand or open to provides an area of greater surface to capture or be pushed by the water flow. Accordingly a surge catcher 18 can dynamically adjust in response to a water flow until it reaches a limit i.e. a filled flap or a fully extended foil, planar element or the like. When said limit is reached the flow of water can propel the water board forward. If at sometime a water board facing shore has a velocity "Vb" that exceeds the velocity of the water "Vw" or is at substantially equilibrium the surge catcher may dynamically respond by surface area changes such as curtailing an opening, rotating to closed, collapsing or folding of sides, collapsing of soft sides or pockets, and/or pivoting of semi-rigid or rigid elements. In other relative terms if the water in front of the water board 502 is moving with less velocity than the water board then the weight of that water moving slower than the velocity of the water appears to push on the surge catcher flap from nose to tail of the water board thereby helping to collapse the surge catcher.

When a surge catcher contracts, relaxes its expansion, moves to a position of closure or collapses whether by having the water board velocity match or exceed the velocity of water previously pushing it, via spill out through apertures, or via a change in water velocity moving towards the proximal end of the surge catcher (or trailing edge) the surface area of the surge catcher open to the flowing water can be reduced thereby reducing drag (by reducing surface area). The impact of the surge catcher on any relatively slower moving water in front of the water board moving towards shore can also help collapse or close a surge catcher. Such a collapse may also improve maneuverability of the water board.

Figure 11A:
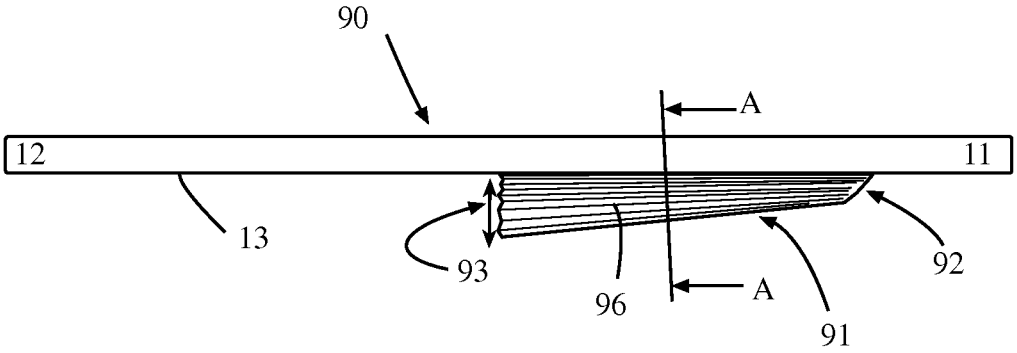
FIGS. 11A and 11B are side and back views of some aspects of exemplary implementations of a water board with surge catcher.
Figure 11B:
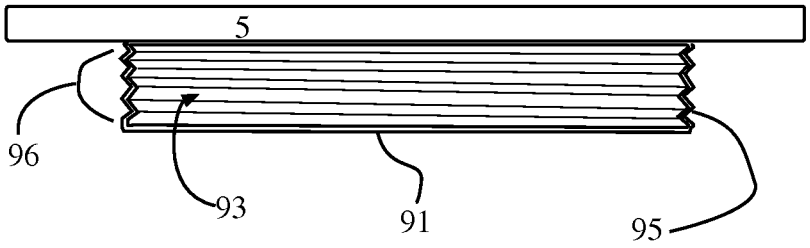

FIGS. 11A and 11B disclose a water board 90 with an accordion surge catcher 91 accordion surge catcher. The distal end of the surge catcher 92 is closed against the bottom 13 of the water board 90. The proximal end 93 is open and a series of folds 95 are formed on at least the side walls 96 of the accordion surge catcher 91. When water moves in to the open proximal end 93 the side walls 96 extend via the folds 95. These folds form a type of living hinge structure and when the water force or movement subsides the living hinge structure collapses the accordion surge catcher. The distal end may have no folds or less pronounced folds to reduce drag as the water board 90 moves through the water.

Figure 12A:
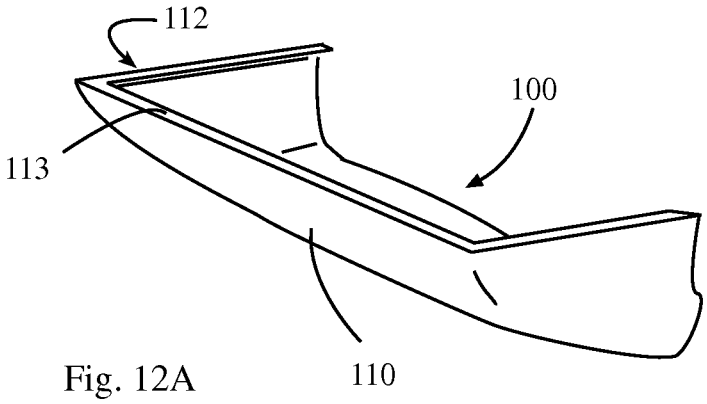
FIGS. 12A and 12B are front perspective and top views of some aspects of exemplary implementations of a surge catcher.
Figure 12B:
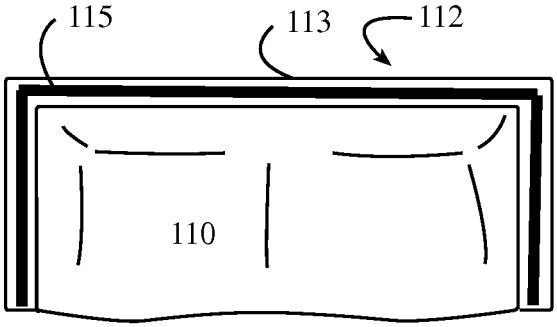

FIGS. 12A and 12B show a front perspective and top view of surge catcher 100. A flap body 110 forms an open pocket of flexible material which can function when immersed in water for a selected time frame. Suitable materials include fabrics, plastics, vinyl, polymer, Surly, Acrel, Dacron, Rayon, HDPE, LDPE, polyester, nylon, polypropylene, Polyethylene, coated fabric, woven plastics, sheet plastic and the like. A frame 112 shown in a "U" shape is affixed to the flap body 110 material and provides a mounting edge 113 whereby a mounting fixture, mounting means, adhesive 115 or glue may be added to affix the surge catcher 100 to a water board. Those of ordinary skill in the art will recognize that a frame may also be formed as top wall or boundary and that configuration is within the scope of this disclosure.

Figure 13:
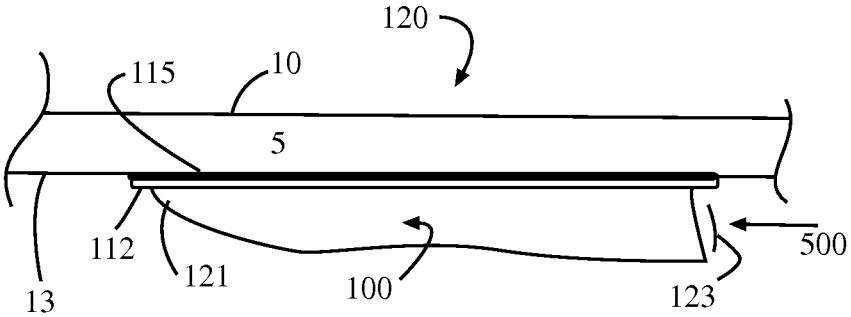
FIG. 13 is a side view of some aspects of an exemplary implementation of surge catcher on a water board.

FIG. 13 illustrates surge catcher 100 affixed with a water board 120. The water board has a deck (or core) 1 with a top 10 and bottom 13. A surge catcher 100 is affixed via adhesive 115 (in this illustration) to the bottom 13 of the water board 120. Upon mounting of the surge catcher 100 with the water board, a closed distal end 121 is formed at one end of the surge catcher pocket and an open extendable/collapsible proximal end 123 is at another end of the surge catcher pocket. The force of water 500 entering or leaving the surge catcher expands or collapses the surge catcher as well as propels the attached water board. Those of ordinary skill in the art will recognize that a frame may also be formed as top wall or boundary and that configuration is within the scope of this disclosure.

Figure 14A:
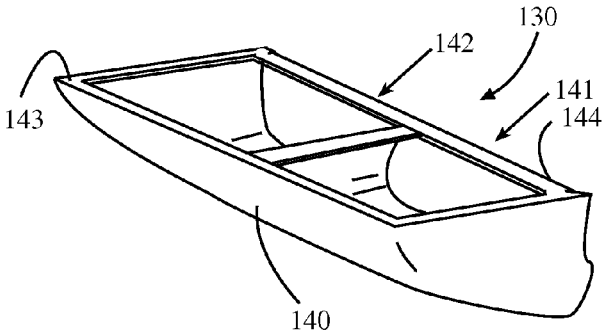
FIGS. 14A and 14B are front perspective and top views of some aspects of an exemplary implementation of a surge catcher.
Figure 14B:
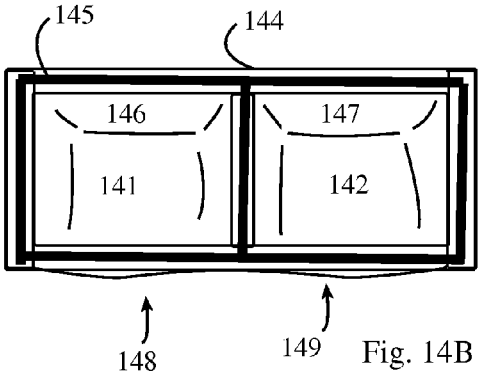

FIGS. 14A and 14B show a front perspective and top view of divided surge catcher 130. A flap body 140 forms multiple open pockets 141 and 142 of flexible material which can function when immersed in water for a selected time frame. Suitable materials include fabrics, plastics, vinyl, polymer, Surlyn, Acrel, Dacron, Rayon, HDPE, LDPE, polyester, nylon, polypropylene, Polyethylene, coated fabric, woven plastics, sheet plastic and the like. A frame 143 shown in an "8" shape is affixed to the flap body 140 material and provides a mounting edge 144 whereby a mounting fixture, mounting means, adhesive 145 or glue may be added to affix the surge catcher 130 to a water board. Each of the multiple pockets 141 and 142 have closed distal ends 146 and 147 and open proximal ends 148 and 149.

Those of ordinary skill in the art will recognize that illustration of two roughly equal sized pockets is not a limitation and a greater number of pockets or an uneven sizing of pockets is within the scope if this disclosure.

Those of ordinary skill will recognize that circular apertures in a body flap or pocket are not a limitation and loosely woven regions of material which allows some limited water flow, slits, other shaped openings and the like are all within the scope of this disclosure.

Figure 15A:
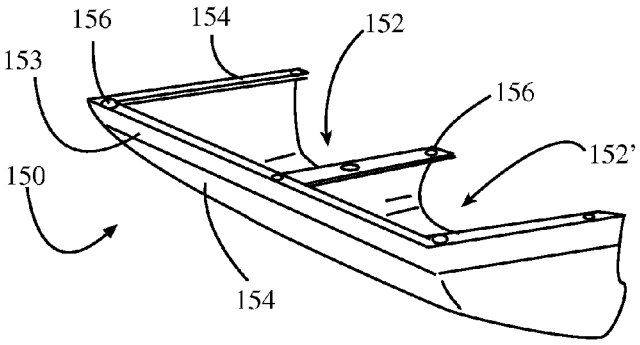
FIG. 15A is a front perspective view of some aspects of an exemplary implementation of a surge catcher.
Figure 15B:
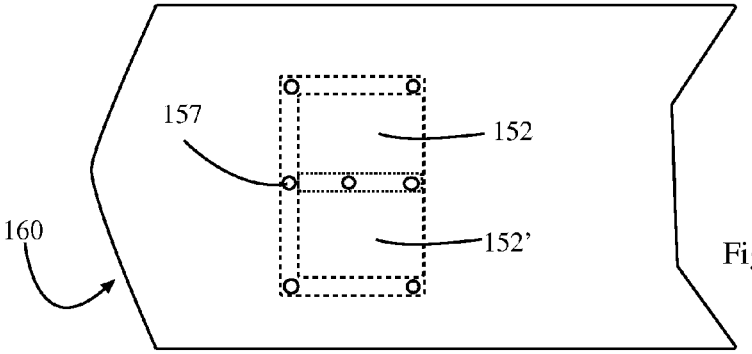
FIG. 15B is a top view of some aspects of an exemplary implementation of a water board mounted surge catcher.

FIGS. 15A and 15B shows a front perspective view of divided surge catcher 150. A flap body forms multiple open pockets 152 and 152'. In this illustration the flap body has a semi-rigid region 153 between the frame 154 and the lower flap body 155. A series of mounting guides 156 are formed in the frame 154 whereby fasteners 157 are extended through a water board 160 into the mounting guides 156 to attach the surge catcher to the water board. Adhesive may also be used in conjunction with said fasteners.

Figure 16A:
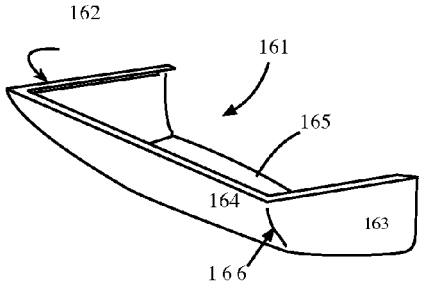
FIGS. 16A-H are views of some aspects of an exemplary implementation of surge catchers.
Figure 16B:
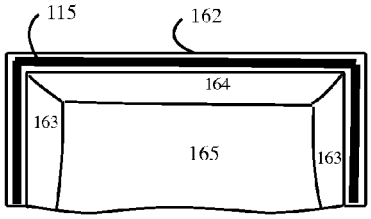
Figure 16C:
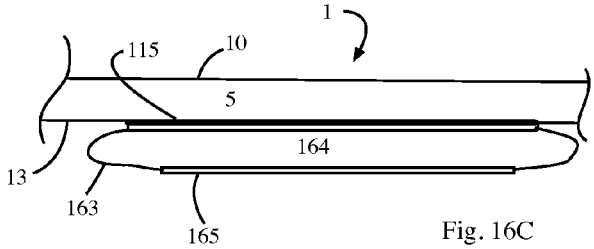

FIGS. 16A, 16B and 16C show a surge catcher 161 with softer and stiffer portions. A "U" shaped frame 162 has two flexible side walls 163 and a flexible front wall 164 attached thereto at one end of each wall. At the other end of each wall a bottom 165, of a material more rigid than the side or front walls, is attached thereby forming a pocket. When attached to a water board 1 the pocket has a closed end (distal) where the front 164 wall resides and an open back side (proximal). The surge catcher with a closed front and an open back (proximal end) is predisposed to collapsing via the front wall and side walls then at the less flexible bottom 165. In some instance the flexible front and side walls may have apertures (not shown) or slits 166 between them whereby some water may pass through when the surge catcher is filling or expanding with water. Upon collapsing such slits may open further thereby allowing yet more water to pass through.

Figure 16D:
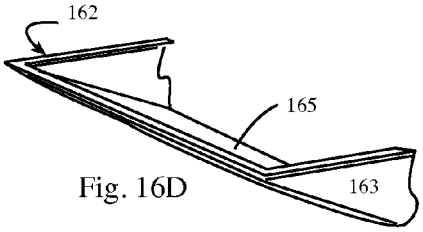
Figure 16E:
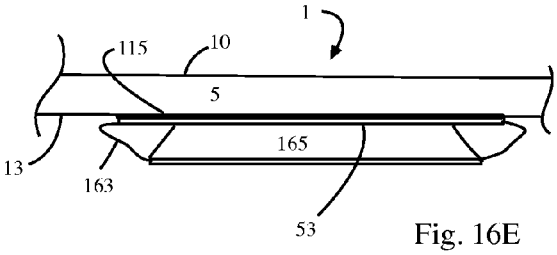

FIGS. 16D and E show a variation on surge catcher 161 wherein the flexible front wall 164 is eliminated and the more ridged bottom 165 extends to the bottom of section 13 of the water board 1 wherein a first end 53 of the bottom 165 is adjacent to the bottom section 13. The first end 53 may or may not be attached to the bottom section. However, by using tapered or triangular flexible side walls 163 the first end 53 may be positioned near the bottom section 13. this flap body 52 is movable affixed to the bottom surface 13. In such an instance a slit aperture may be formed at the area of the bottom of the water board bottom section adjacent to the first end. In other instances a barrier such as a gasket, seal or other resilient member may be interposed between the first end and bottom section to reduce the aperture size.

Figure 16F:
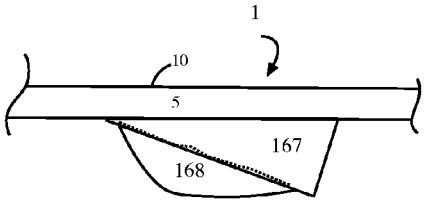
Figure 16G:
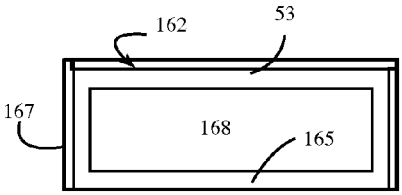

FIGS. 16F and G show a variation on surge catcher 161 wherein the flexible front wall 164 and flexible front wall 164 are eliminated. Rather semi-ridged or ridged side walls 167 are formed on the "U" shaped frame 162 and the bottom 165 has one or more soft extendable catches 168 which respond to the force of faster moving water filling the surge catcher by extending via stretching as shown in FIG. 16F. When the water flow is reduced or the relative speed of the water board compared to the flow of water become less dis-similar the one or more extendable catches relax and/or collapse.

Figure 16H:
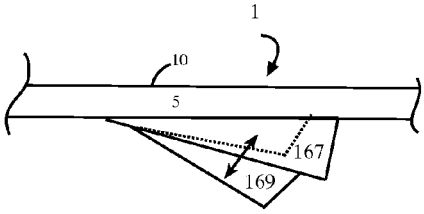

FIG. 16H shows a variation on surge catcher 161 wherein the flexible front wall 164 and flexible front wall 164 are eliminated. Rather semi-ridged or ridged side walls 167 are formed on the "U" shaped frame 162 and the bottom 165 has one or more semi-ridged extendable catches 169 which respond to the force of faster moving water filling the surge catcher by extending as shown in FIG. 16H. When the water flow is reduced or the relative speed of the water board compared to the flow of water become less dis-similar the one or more extendable catches collapse.

Figure 17A:
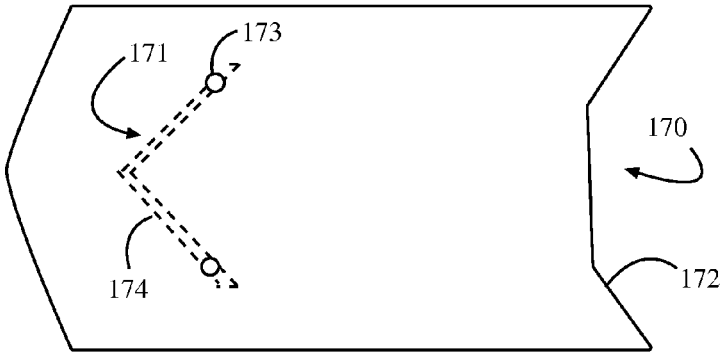
FIG. 17A is a top view of some aspects of an exemplary implementation of water board and mounted surge catcher.
Figure 17B:
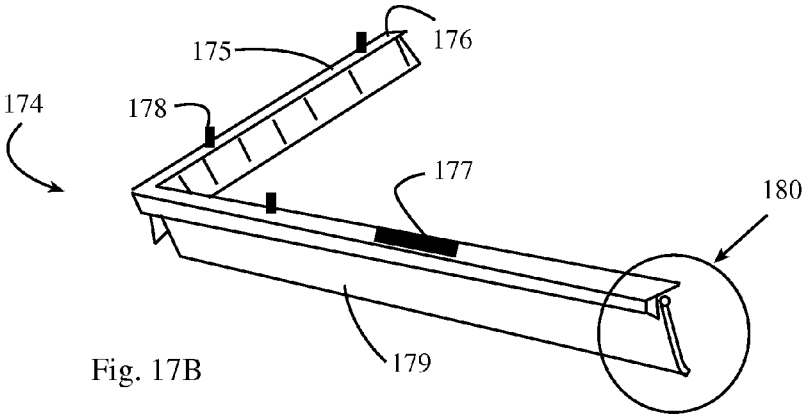
FIGS. 17B-D are perspective and side views of some aspects of exemplary implementations of foil surge catchers.
Figure 17D:
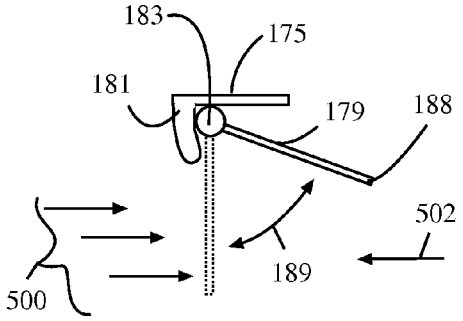
Figure 17C:
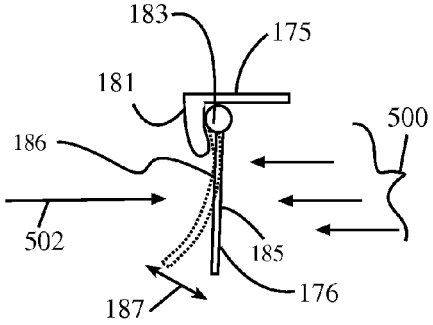

FIG. 17A show an exemplary implementation of a water board with dynamic active propulsion 170. The inertia of a stationary board in the ocean near shore can be overcome, in part, by utilizing the activity of a wave. A surge catcher 171 is affixed to the bottom of a water board is shown. Affixation may be via glue or adhesives, sonic weld, fasteners 173 and/or latches and catches. FIGS. 17B-D show views of a surge catcher 171. A "V" shaped frame 175 with a top interface 176 to mate with the bottom of a water board may be bonded, glued, welded and/or fastened to a water board. Adhesive strips or glue 177 may be used. Alternatively or in conjunction with adhesives, fastening elements such as raised legs or pins 178 may be attached to or formed as part of said top interface 176—such pins 178 are extendable into a water board wherein they may be glued, latched and/or connected with a catch. Two movable foils 179 are hinged movably to the "V" shaped frame. A rotational interface 180 is shown in two different positions in FIGS. 17C and 17D. The rotational interface 180 is a means to rotate the foil relative to the water board in response to the forces of flowing water. The rotational interface comprises the top interface 176, an extended stop 181, a hinge 183 and a foil 179. Those of ordinary skill in the art will recognize that rotational interface is an area whereby the foil is movably affixed to the bottom surface of the water board and design choices for such rotational means include, but are not limited to, hinges, pivots, living hinges, flexible joints, gaskets, bearings, bushings, articulating members, guides and the like. An extended member such as When the speed of the water 500 pushing against the foil's backside 185 (as shown in FIG. 17C) exceeds the speed of the water 502 moving towards the front side 186 the foil is extended downward away from the bottom of an attached water board (also generally perpendicular from the top interface). Preferably the foil 176 is flexible enough to allow some over extended movement along the line of arrow 187.

When the speed of the water 500 pushing against the foil's backside 185 (as shown in FIG. 17D) is less than the speed of the water 502 moving towards the front side 186 the foil rotates on a rotational interface to collapse upward towards from the bottom of an attached water board. With the furthest end of the foil 188 moving away from perpendicular with the top interface to a more congruent position along the line of arrow 189.

Figure 18A:
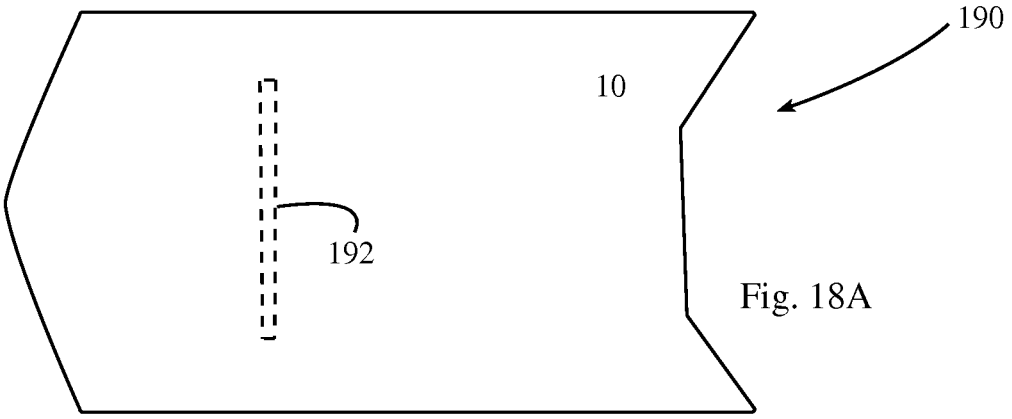
FIGS. 18A and 18B are top and front perspective views of some aspects of an exemplary implementation of water boards and of a foil surge catcher.
Figure 18B:
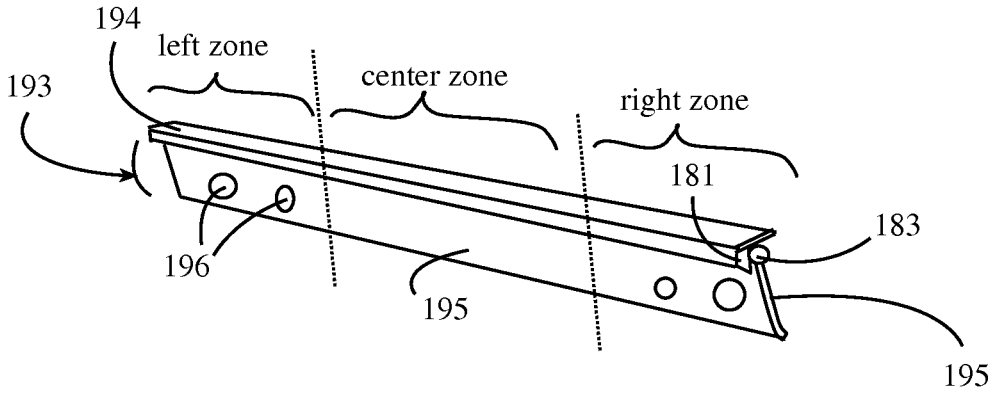
Figure 19A:
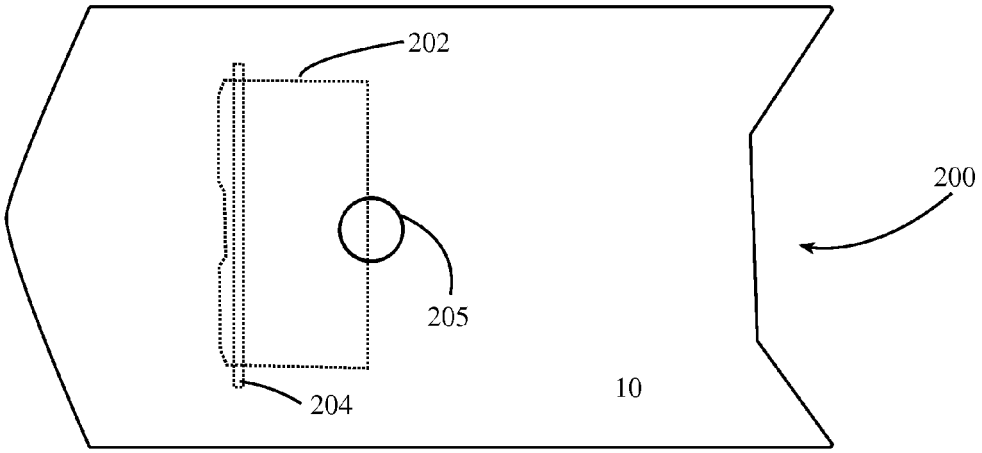
FIG. 19A-E are top and side views of some aspects of exemplary implementations of water boards with an actuated surge catcher.
Figure 19B:
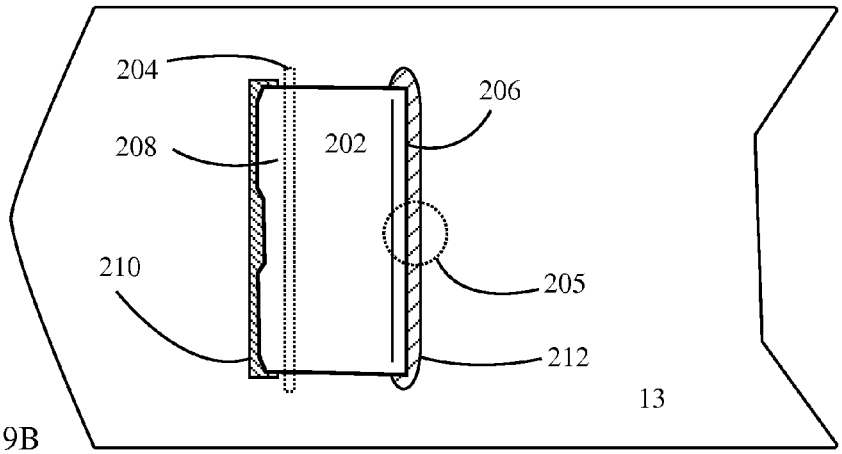
Figure 19C:
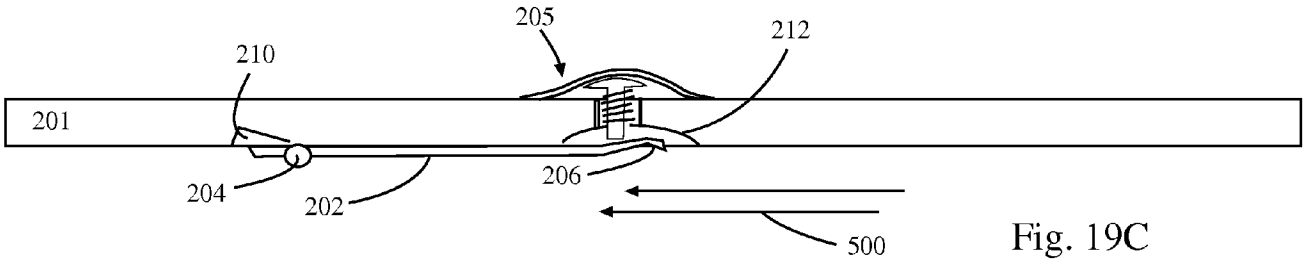
Figure 19D:
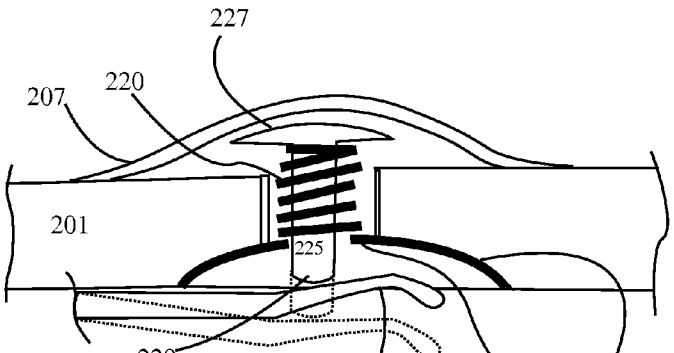
Figure 19E:
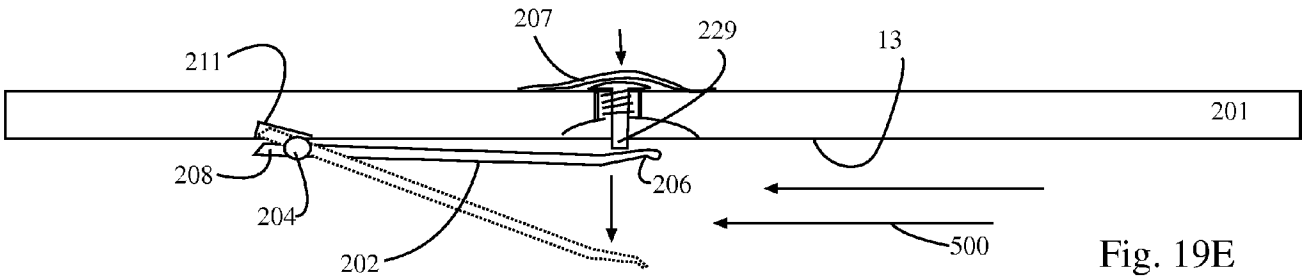

FIGS. 18A and 18B shows an exemplary implementation of a single foil blade foil surge catcher and water board 190 water board with dynamic propulsion 170. The inertia of a stationary board in the ocean near shore can be overcome, in part, by utilizing the activity of a wave. A surge catcher 192 is affixed to the bottom of a water board is shown. Affixation may be via glue or adhesives, pegs, arms, legs, sonic weld, fasteners and/or latches and catches. A generally linear frame 193 has a top interface 194 to mate with the bottom of a water board/The mating or attachment may be via bond, glue, weld and/or fastener. Adhesive strips or glue may be used. The affixing of the surge catcher, dynamic pocket or flexible pocket may be after the production (post production) of the water board. The added pocket may be an add-on Alternatively or in conjunction with adhesives, fastening elements such as raised legs or pins may be attached to or formed as part of said top interface—such pins are extendable into a water board wherein they may be glued, latched and/or connected with a catch. The movable foil 195 is hinged movably to the frame. An exemplar of a hinge interface 180 is shown in FIG. 17B-D. The hinge interface comprises the top interface 194, an extended stop 181, a hinge 183 and a foil 195. Apertures 196 may be added. If one views the linear frame as having a left zone, a right zone and center zone, apertures may be formed in a particular zone or two zones to "steer" the propulsion. More particularly, with apertures formed in the left and right zones greater water flows through such zones when the force of water is pushing on the foil. An un aperture center zone contiguous with the aperture left and right zones has more force against it from the same water flow thereby pushing the water board to a greater extent generally along the center line of the water board. The call out of a "hinge" is not intended as a limitation with respect to other rotational means that may be utilized to provide the "hinge" affixation and rotational functionality.

When the speed of the water 500 pushing against the foil's backside 185 (as shown in FIG. 17C) exceeds the speed of the water 502 moving towards the front side 186 the foil is extended downward away from the bottom surface of an attached water board (also generally perpendicular from the top interface). Preferably the foil 176 is flexible enough to allow some over extended movement along the line of arrow 187.

When the speed of the water 500 pushing against the foil's backside 185 (as shown in FIG. 17D) is less than the speed of the water 502 moving towards the front side 186 the foil rotates to collapse upward towards from the bottom of an attached water board. With the furthest end of the foil 188 moving away from perpendicular with the top interface to a more congruent position along the line of arrow 189.

FIGS. 19A-19E show a top, bottom, cut-away side and enlarged view of a user activation surge catcher and water board 200. The water board 201 is shown with a semi rigid propulsion surge catcher panel 202. The panel is constructed of at least one of, plastics, vinyl, polymer, Surlyn, Acrel, HDPE, LDPE, nylon, polypropylene, and polyethylene, polymer, resin, high density foam and aluminum. The panel is connected to, or formed with, a pivot means 204. A pressure actuator system is a mechanical means to move a portion of the surge catcher panel into the flow (current) of water. Looking at the surge catcher panel 202 from the bottom side 13 of the water board 201 shows a trailing edge 206 a buttress edge 208 and a buttress cavity 210 and a trailing edge recess 212. In a cut away and exploded view 19C-E the trailing edge recess 212 provides a catch 215 for a spring 220 surrounding an elongated actuator 225. The actuator 225 has a head 227 and a foot 229, also shown is a flexible cover 207 above actuator head. When a user depresses the flexible cover 207 the actuator head 227 compresses the spring 225 and pushes the trailing edge 206 of the surge catcher panel 202 out of the recess 212 and positioned to pivot away from the bottom of the water board as moving water 500 pushes on it. The surge catcher panel 202 has limited rotational movement due to the buttress edge 208 which fits into the buttress cavity 210 and a top wall 211 of said buttress cavity acts as a stop to limit the rotation of the buttress edge 208 beyond a pre-selected limit. When the water board is moving at or beyond the speed of the water 500 the surge catcher panel 202 can rotate back to less extended position, including but not limited to, generally parallel with the bottom surface 13 of the water board.

Figure 20A:
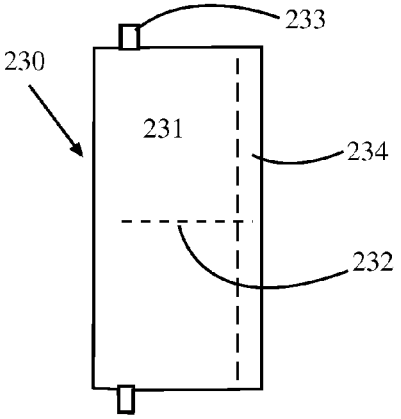
FIGS. 20A-20B are top and side views of some aspects of exemplary implementations of a surge catcher.
Figure 20B:
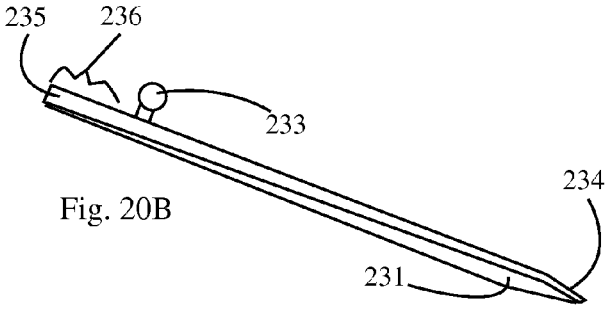

FIGS. 20A and 20B show a top and side view of a rotatable semi-rigid surge catcher 230 having a generally rectangular planer body 231 with two halves divided by a centerline 232 that may demarcate a peak or valley in the generally planar body 231. The centerline is optional. A pivot 233 is formed on, or attached to, two opposing sides of the planar body 231. A trailing edge 234 may be optionally formed at the end of one of the for sides. The trailing edge 234 may be shaped or angled to better act as a catch or lift to support rotation of the surge catcher 230 around a mounted pivot. The planar body 231 has a side edge 235 around it. The leading edge set forward of the pivot 233 also functions as a buttress to control rotation when the surge catcher is affixed to a water board.

Figure 21A:
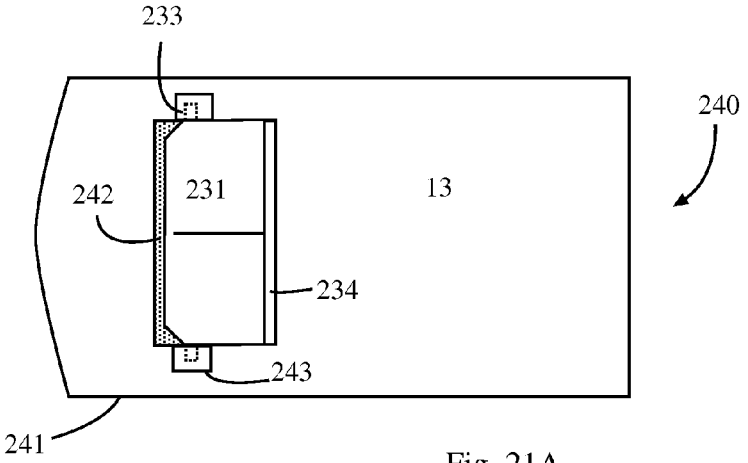
FIGS. 21A-21B are bottom and side views of some aspects of exemplary implementations of water board with mounted surge catcher.
Figure 21B:
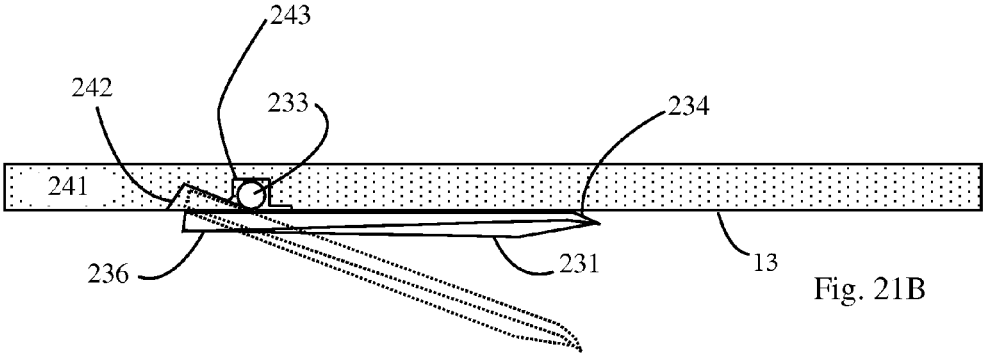

FIGS. 21A and 21B show a propulsion device and system mounted on a water board 240. Surge catcher 230 is affixed rotatably to a water board 241. The water board has a buttress catch 242 at a preselected depth in the water board which acts as a stop to limit rotation of the surge catcher about the pivot 233. The pivot is affixed within a guide 243. The guide is preferably a resilient plastic or metal component firmly fixed to the water board and providing a generally circular mount for the pivot 233. The buttress catch 242 acts as a stop limit whereby a surge catcher rotating on its pivots 233 has a limit placed on its extension to a preselected angle. The leading edge 236 functions as a stop when it reaches a wall impeding it's rotational movement.

Figure 22A:
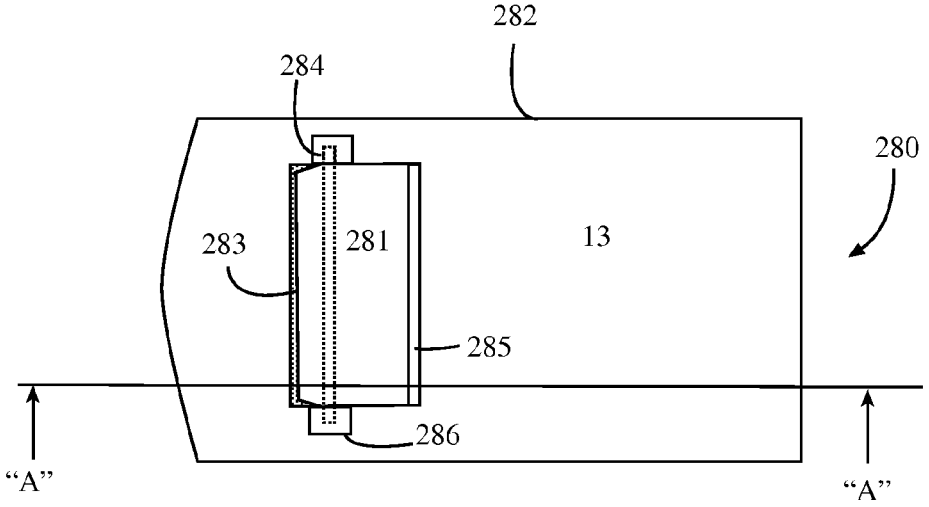
FIGS. 22A-22B are bottom and side views of some aspects of exemplary implementations of water board with mounted surge catcher; and, FIG. 23 is a side view of some aspects of an exemplary implementation of a water board with surge catcher.
Figure 22B:
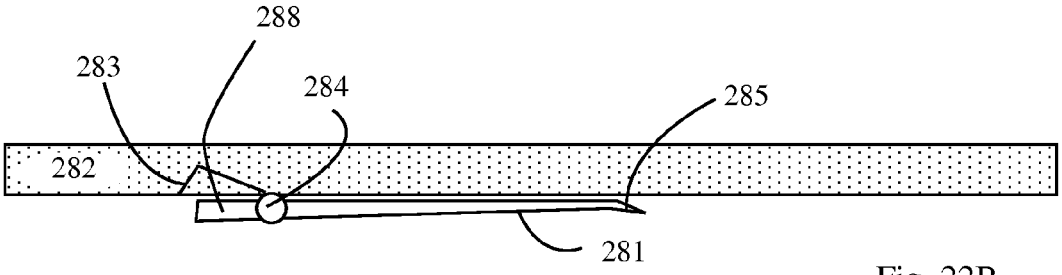

FIGS. 22A and 22B show a propulsion device and system mounted on a water board 280. FIG. 22B is a cut-away view along arrow A-A. Surge catcher 281 is affixed rotatably to a water board 282. The water board has a buttress catch 283 at a preselected depth in the water board which acts as a stop to limit rotation of the surge catcher about the pivot 284. A trailing edge 285 of the surge catcher is angled downward relative to the bottom surface 13 of the water board whereby it is positioned to catch the flow of a water current with greater velocity than said water board. The trailing edge may help swing downward or rotate the surge catcher 281 to receive the flow of current and thereby push on the surge catcher to propel the water board. The pivot is affixed within a guide 286. The guide is preferably a resilient plastic or metal component firmly fixed to the water board and providing a generally circular mount for the pivot 284. The buttress catch 283 acts as a stop limit whereby a leading edge 288 of the surge catcher as it rotates around the pivot has its progress impeded by a wall. Although not essential, it is preferred that the buttress catch be a cavity in the bottom surface 13 of the water board so that the leading edge 288 may lay generally parallel with the bottom surface 13 when the surge catcher is un extended and then nest in the cavity as the surge catcher extended until the stop limit is reached. has a limit stop thereby limiting the rotation of the surge catcher about its picot(s) 284.

Figure 23:
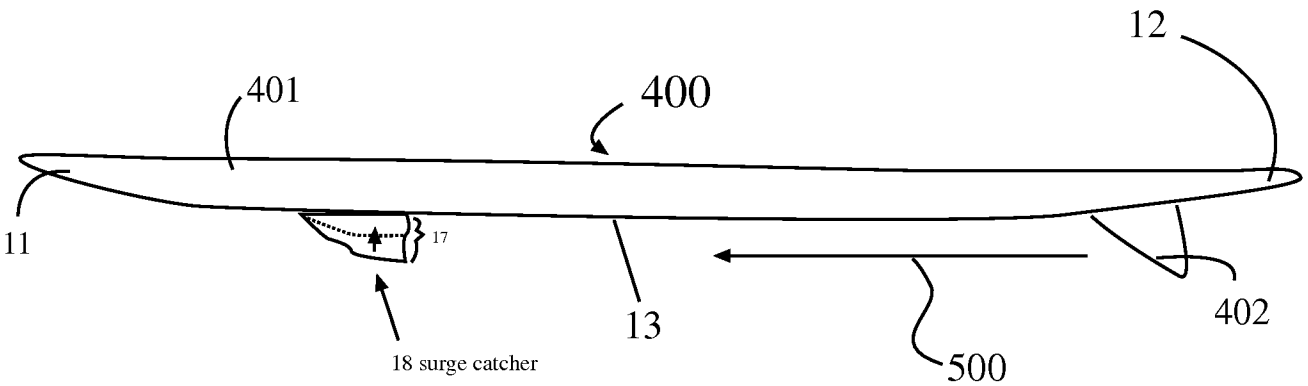

FIG. 23 illustrates an exemplary implementation of a surf board (a subset of water boards) and surfboard 400. The surf board 401 has a tail fin 402 a its rear 12 and a surge catcher 18 affixed to its bottom.

While the method and agent have been described in terms of what are presently considered to be the most practical implementations and aspects thereof, it is to be understood that the disclosure need not be limited to the disclosed implementations, aspects or order and/or sequence of combination of aspects. It is intended to cover various modifications and similar arrangements included within the spirit and scope of the claims, the scope of which should be accorded the broadest interpretation so as to encompass all such modifications and similar structures. The present disclosure includes any and all implementations of the following claims.

It should also be understood that a variety of changes may be made without departing from the essence of the disclosure. Such changes are also implicitly included in the description. They still fall within the scope of this disclosure. It should be understood that this disclosure is intended to yield a patent covering numerous aspects both independently and as an overall system and in both method and apparatus modes.

Further, each of the various elements of the disclosure and claims may also be achieved in a variety of manners. This disclosure should be understood to encompass each such variation, be it a variation of an implementation of any apparatus implementation, a method or process implementation, or even merely a variation of any element of these.

Particularly, it should be understood that as the disclosure relates to elements of the implementation, the words for each element may be expressed by equivalent apparatus terms or method terms—even if only the function or result is the same.

Such equivalent, broader, or even more generic terms should be considered to be encompassed in the description of each element or action. Such terms can be substituted where desired to make explicit the implicitly broad coverage to which this disclosure is entitled.

It should be understood that all actions may be expressed as a means for taking that action or as an element which causes that action.

Similarly, each physical element disclosed should be understood to encompass a disclosure of the action which that physical element facilitates.

Any patents, publications, or other references mentioned in this application for patent are hereby incorporated by reference. In addition, as to each term used it should be understood that unless its utilization in this application is inconsistent with such interpretation, common dictionary definitions should be understood as incorporated for each term and all definitions, alternative terms, and synonyms such as contained in at least one of a standard technical dictionary recognized by artisans and the Random House Webster's Unabridged Dictionary, latest edition are hereby incorporated by reference.

Finally, all referenced listed in the Information Disclosure Statement or other information statement filed with the application are hereby appended and hereby incorporated by reference; however, as to each of the above, to the extent that such information or statements incorporated by reference might be considered inconsistent with the patenting, such statements are expressly not to be considered as made by the applicant(s).

In this regard it should be understood that for practical reasons and so as to avoid adding potentially hundreds of claims, the applicant has presented claims with initial dependencies only.

Support should be understood to exist to the degree required under new matter laws—including but not limited to United States Patent Law 35 USC 132 or other such laws—to permit the addition of any of the various dependencies or other elements presented under one independent claim or concept as dependencies or elements under any other independent claim or concept.

To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternatives.

Further, the use of the transitional phrase "comprising" is used to maintain the "open-end" claims herein, according to traditional claim interpretation. Thus, unless the context requires otherwise, it should be understood that the term "compromise" or variations such as "comprises" or "comprising", are intended to imply the inclusion of a stated element or step or group of elements or steps but not the exclusion of any other element or step or group of elements or steps. Such terms should be interpreted in their most expansive forms so as to afford the applicant the broadest coverage legally permissible. All callouts associated with figures are hereby incorporated by this reference.

Since certain changes may be made in the above system, method, process and or apparatus without departing from the scope of the disclosure herein involved, it is intended that all matter contained in the above description, as shown in the accompanying drawing, shall be interpreted in an illustrative, and not a limiting sense.

While various embodiments of the disclosure have been described, it will be apparent to those of ordinary skill in the art that many more embodiments and implementations are possible within the scope of this disclosure. Moreover, it will be understood that the foregoing description of numerous implementations has been presented for purposes of illustration and description. It is not exhaustive and does not limit the claimed disclosures to the precise forms disclosed. Modifications and variations are possible in light of the above description or may be acquired from practicing the disclosure. The claims and their equivalents define the scope of the disclosure. Accordingly, the disclosure is not to be restricted except in light of the attached claims and their equivalents.

I claim:

1. A method of water board propulsion, the method comprising:

placing a buoyant water board equipped with a bifurcated flexible water-catching pocket in a current of flowing water, said bifurcated flexible water-catching pocket affixed to a bottom surface of the water board and having an open proximal end and at least a partially closed distal end and comprising strips that bifurcate the pocket so as to limit the downward movement of bottom of the pocket;

and said current of water moving at a speed which is faster than the water board;

positioning said open proximal end of the bifurcated flexible water-catching pocket to receive the current of flowing water thereby allowing the current of flowing water to flow into the open proximal end and expand the bifurcated flexible water catching pocket and accelerating the board forward with an acceleration greater than the same water board, but without the bifurcated water catching flexible pocket, would experience under otherwise identical conditions.

2. The method of claim 1, the method further comprising allowing a portion of the water filling the pocket to vacate the pocket via apertures in the pocket.

3. The method of claim 1, the method further comprising the flexible water catching pocket dynamically expanding as water flows into said pocket.

4. The method of claim 3, the method further comprising the flexible water catching pocket at least partially dynamically collapses when the water board's speed is at least about equal to the speed of the current water.

5. The method of claim 3, the method further comprising the flexible water catching pocket at least partially collapsed when the water board's speed is greater than the speed of the current water.

* * * * *